US006716003B2

(12) United States Patent
Chen

(10) Patent No.: US 6,716,003 B2
(45) Date of Patent: Apr. 6, 2004

(54) STRUCTURE FOR AN AIR PUMP

(76) Inventor: Chih-Ming Chen, P.O. Box 82-144, Taipei (TW)

( * ) Notice: Subject to any disclaimer, the term of this patent is extended or adjusted under 35 U.S.C. 154(b) by 61 days.

(21) Appl. No.: 10/138,311

(22) Filed: May 6, 2002

(65) Prior Publication Data

US 2003/0206816 A1 Nov. 6, 2003

(51) Int. Cl.[7] ..... F04B 17/00

(52) U.S. Cl. ..... 417/415; 417/423.8; 417/423.6; 417/368; 417/371; 417/544

(58) Field of Search ..... 417/415, 423.8, 417/423.6, 423.14, 459, 465, 423.7, 366, 368, 371, 544

(56) References Cited

U.S. PATENT DOCUMENTS 2,081,025 A * 5/1937 Watt ..... 417/459
2,653,756 A * 9/1953 Tveden ..... 417/265
4,746,097 A * 5/1988 Chung et al. ..... 254/93 H
4,836,755 A * 6/1989 Nitsche et al. ..... 417/368
5,255,643 A * 10/1993 Mochizuki et al. ..... 417/212
5,600,953 A * 2/1997 Oshita et al. ..... 60/453
6,068,457 A * 5/2000 Dewhirst ..... 417/423.6

* cited by examiner

*Primary Examiner*—Justine R. Yu
*Assistant Examiner*—Michael K. Gray
(74) *Attorney, Agent, or Firm*—Leong C. Lei

(57) ABSTRACT

An air pump is provided with a motor body having an air slot to allow air to flow from the air slot to air inlets positioned in a front sealing cap of the motor body. The air inlets are aligned with air holes in a closed housing. A shaft of the motor body extends into the closed housing which houses a piston. The shaft of the motor body is connected to gearing mechanisms in the closed housing to provide reciprocating motion of the piston. The piston includes an air inlet and a valve. The reciprocating movement of the piston causes air to travel through the piston into a cylinder above the piston. The design of the pump affords a cooling function to both the motor body and cylinder while reducing the noise of the pump.

13 Claims, 6 Drawing Sheets

STRUCTURE FOR AN AIR PUMP

BACKGROUND OF THE INVENTION (a) Field of the Invention

The present invention relates to an improved structure for an air pump and in particular, to an air pump having a motor body and cylinder which can be rapidly cooled and which is sealed to isolate the noise of operation.

(b) Description of the Prior Art

FIG. 8 shows a closed type mini-size air pump A1. The pump A1 includes a motor body A2 and a cylinder body A3. This conventional air pump reduces the noise production from the motor but a heat dissipation problem of the motor remains present. This drawback (heat) may cause the motor to be overheated and damaged. Further, the air pump may not function properly to provide sufficient pressurized air. Occasionally the pump has to be stopped in order to provide a proper function. The cylinder top cap A4 is provided with flapper valves or sealing pads A5, A5' that are positioned on a valve plate.

When the piston A31 moves downward, the bottom sealing pad A5 will open as a result of a suction force. At the same time, the pad A5' is sucked downward to seal the air outlet A42 so the air can freely enter the air inlet A41. When the piston A31 moves upward, the top seal pad A5' will be repelled as a result of the internal pressure of the piston A31 and the pressurized air is discharged to an extension tube A6. In view of this, the piston A31 moves up and down to provide pressure for the air pump.

The conventional motor A1 does not provide heat dissipation in the course of operation. In view of the structure, the motor A2 is linked to the piston A31 with a crankshaft. The reciprocation movement will produce compressed air. Thus, the function of the conventional air pump is restricted by the gear system as well as the shaft. Accordingly, it is an object of the present invention to provide an improved structure for an air pump which will mitigate the drawbacks.

SUMMARY OF THE INVENTION

Accordingly, it is an object of the present invention to provide an improved structure for an air pump. The air pump includes a motor body having a main shaft and having a front sealing cap that is provided with a plurality of air inlets. A cylinder seat having a plurality of air holes is connected to the motor body such that the plurality of air holes are positioned in corresponding relation to the plurality of air inlets such that air is allowed to flow from the motor body into the cylinder seat. The cylinder seat has a main shaft hole for accommodating the main shaft. A driving gear is connected to the main shaft and an eccentric gear engages the driving gear. One side of the eccentric gear has a center shaft and an opposite side of the eccentric gear has an eccentric linking shaft. The center shaft is accommodated in a sealed hole in the cylinder seat. A piston is provided with a piston shaft having a shaft seal. The shaft seal is connected to the eccentric linking shaft to allow for reciprocating movement of the piston. A silencer cap having a top section forms a circular engagement mount with a top section of the cylinder seat. A cylinder mount is positioned within the circular mount so as to accommodate the piston. A cylinder top cap is positioned over the cylinder mount. A locking screw locks the motor body to the cylinder seat.

The plurality of air holes are positioned at the circumferential edge of the shaft hole on the cylinder seat. A bolt seals the silencer cap to the cylinder seat so that the piston shaft, driving gear and eccentric gear are positioned within. The cylinder top cap is provided with an edge section which is enclosed by the circular mount. The top sections of the cylinder seat and silencer cap, the cylinder mount, and the edge section of the cylinder cap are simultaneously secured by a locking screw.

Yet another object of the present invention is to provide an improved structure for an air pump, wherein the produced noise is isolated.

A further object of the present invention is to provide an improved structure for an air pump, wherein the motor body and the cylinder can be rapidly cooled, and the device is efficiently and effectively operated.

The foregoing object and summary provide only a brief introduction to the present invention. To fully appreciate these and other objects of the present invention as well as the invention itself, all of which become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
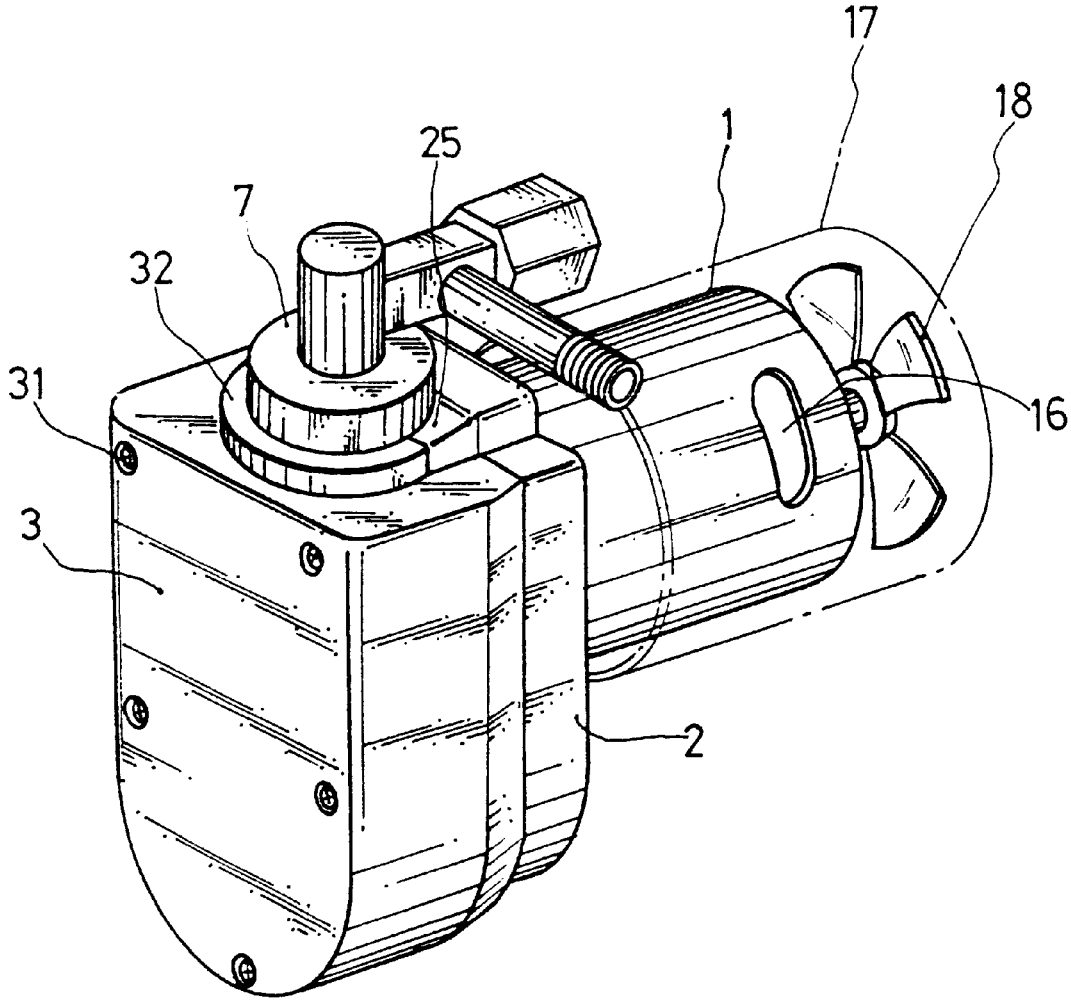
FIG. 1 is a perspective view of a preferred embodiment of the present invention.
Figure 2:
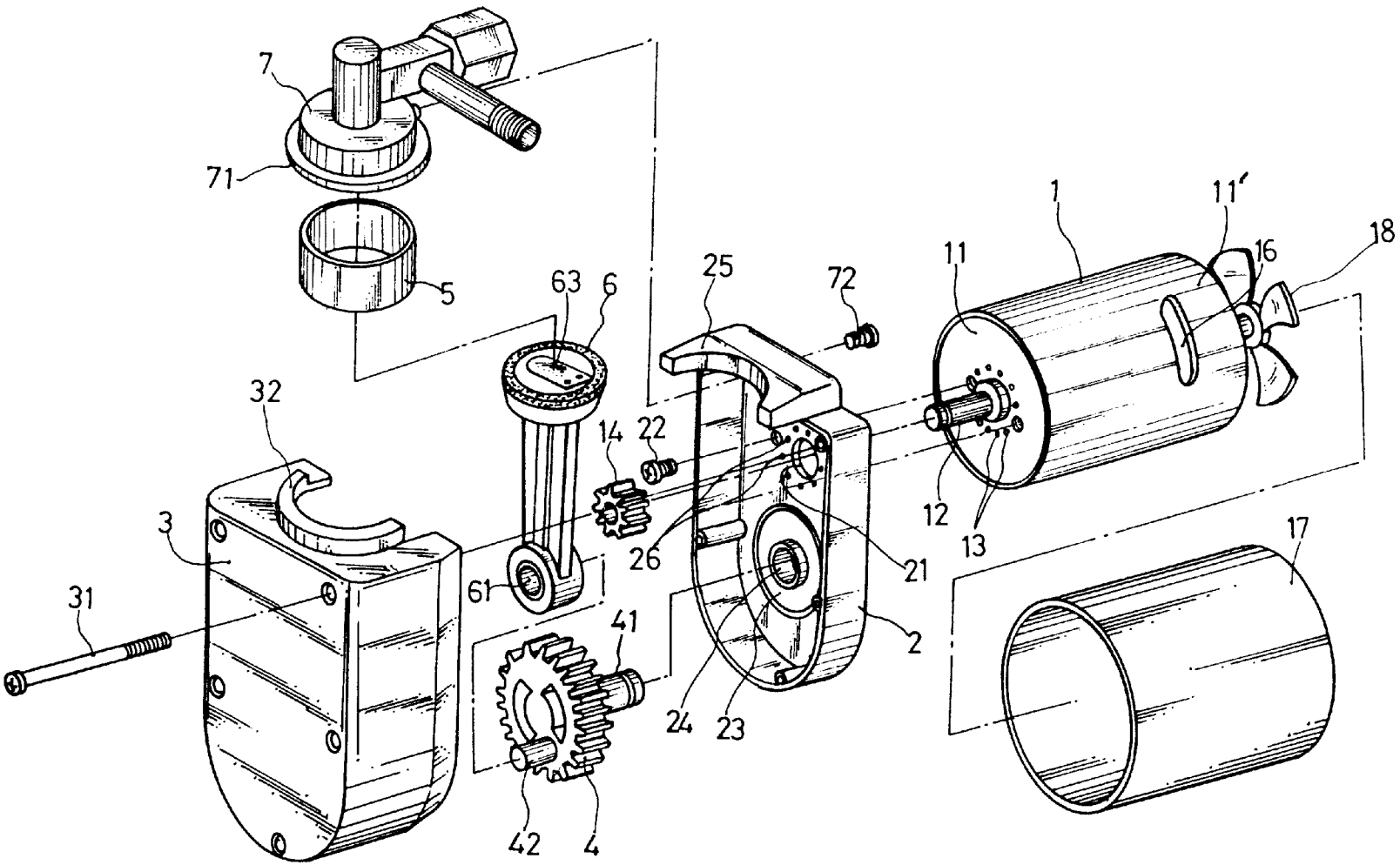
FIG. 2 is a perspective exploded view of the present invention.

Referring to FIGS. 1 and 2, the air pump of the present invention comprises a motor 1, a cylinder seat 2, a silencer cap 3, a gear system which includes an eccentric gear 4, a cylinder mount 5, a piston 6, a cylinder top cap 7, wherein the motor body 1 employs a front sealing cap 11 to seal off the front opening and a rear sealing cap 11' to seal off the rear opening.

Figure 4:
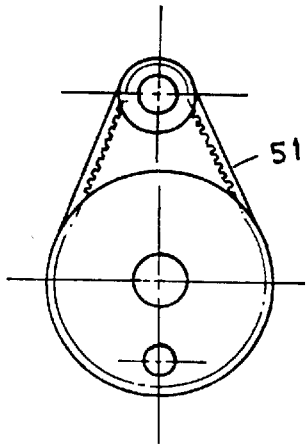
FIG. 4 is a schematic view showing the pump with a belted wheel of the present invention.

The front seal sealing cap 11 allows the main shaft 12 to be protruded and is provided with a plurality of air inlets 13. After the main shaft 12 passes through a shaft hole 21 on the cylinder seat 2, a locking screw 22 is used to lock the motor body 1 onto the cylinder seat 2. The motor main shaft 12 is engaged with a driving gear 14. The driving gear 14 is engaged with eccentric gear 4 by a belted wheel 51 (FIGS. 4 and 5), so that power is transmitted to the eccentric gear 4 and the RPM ratio is reduced and the operational torque is improved. An end of the motor main shaft 12 extends through the motor body 1 to engage with a fan 18. Further, the motor body 1 is enclosed within a cylindrical casing 17.

The eccentric gear 4 eccentrically drives the piston 6. The center shaft 41 which is positioned on one side of the eccentric gear 4 is accommodated by a hole 24 formed on a seal 23 which engages the wall of the cylinder seat 2. The eccentric gear 4 acquires the force from the driving gear 14 to provide a rotational function. The other side of the eccentric gear 4 is provided with an eccentric linking shaft 42 connected to a seal 61 of a piston shaft 66. By way of eccentric rotation, the entire piston shaft 66 produces an up-down reciprocating movement.

Figure 5:
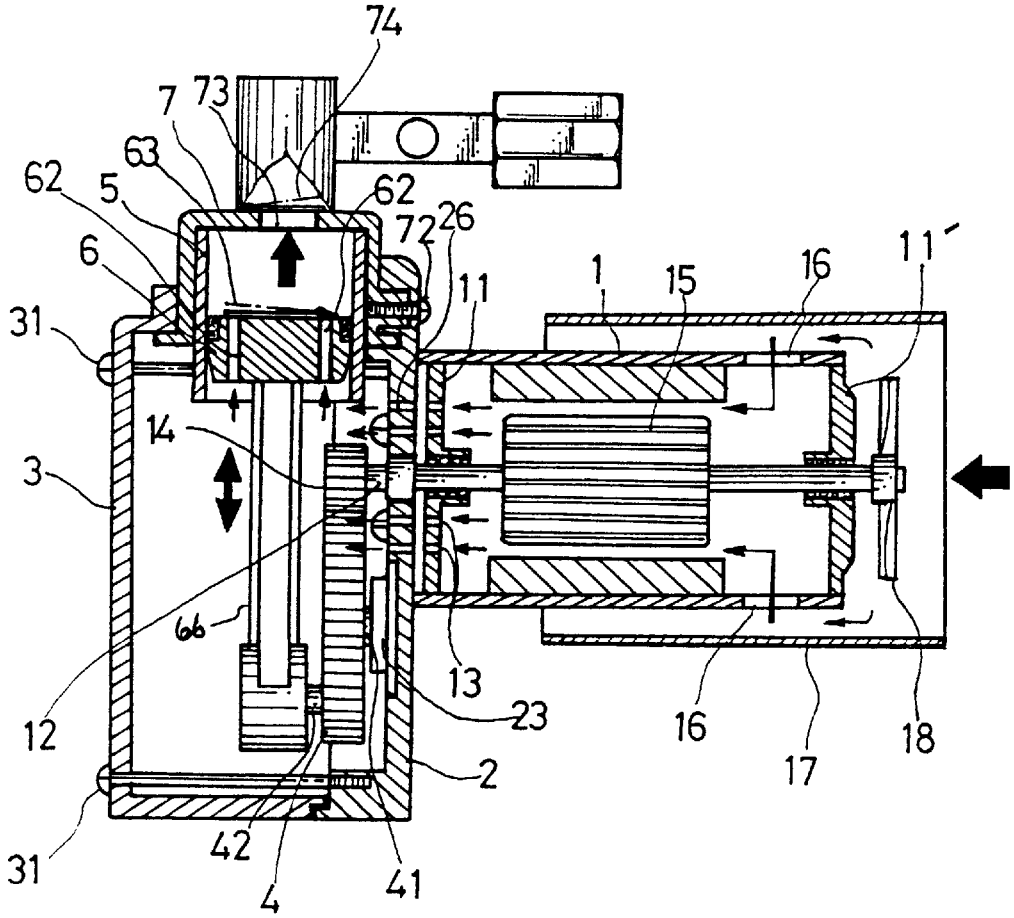
FIG. 5 is a sectional view of the air pump in accordance with the present invention.

As shown in FIG. 5, the front of the cylinder seat 2 is sealed off with a hollow silencing cap 3. By way of screw bolt 31, the cylinder seat 2 is locked together with the silencing cap 3 so as to enclose the piston 6, driving gear 14 and eccentric gear 4.

In the course of locking the cylinder seat 2 and the silencing cap 3, their respective top sections 25, 32 are formed into a circular engaging mount for enclosing the edge section 71 of the cylinder top cap 7 and the cylinder mount 5. A locking screw 72 is provided for simultaneously securing the respective top sections 25, 32, the edge section 71 of the cylinder top cap 7 and the cylinder mount 5 thereby allowing the piston 6 to move up and down in an enclosed cylinder.

Figure 3:
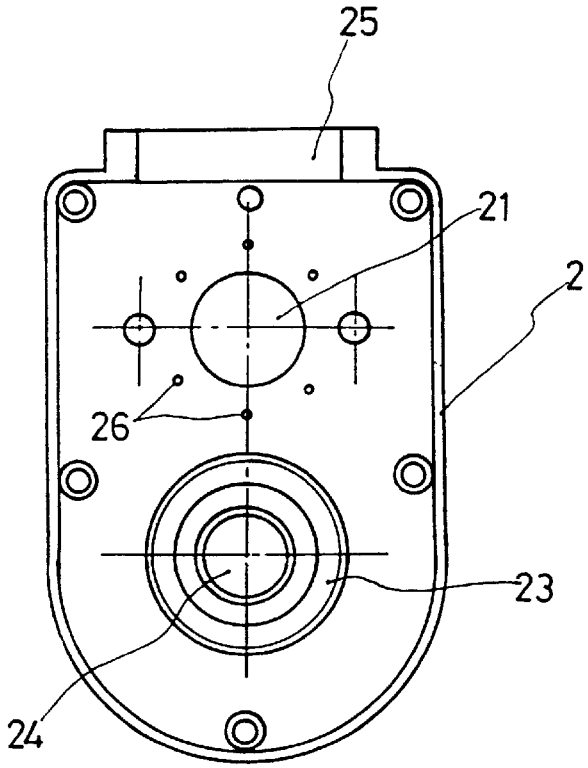
FIG. 3 is a plan view of the cylinder seat of the present invention.

As shown in FIG. 3, the circumferential edge of the shaft hole 21 of the cylinder seat is provided with a plurality of air holes 26 which correspond to the air inlets 13 of the front sealing cap 11. As shown in FIG. 5, when the motor body 1 is in operation, the motor 15 rotates rapidly to form air turbulence.

Due to rapid up and down movement of the piston 6, suction force is produced and air is drawn through the air slot 16 of the motor body. The air goes through inlet/holes 13, 26 to the cylinder mount 5 so that heat dissipation of the motor body 1 and cylinder mount 5 is obtained.

With regards to the air intake and discharge of the piston 6, the piston 6 is provided with air inlets 62. A valve or sealing pad 63 is provided on top of the piston 6. When the piston moves downward, the instantaneous push of the air pressure pushes the sealing pad 63 to an open position to allow air to travel through the air inlet 62 to the cylinder 5.

When the piston 6 moves upward, the sealing pad 63 closes. A second valve or second sealing pad 74 positioned at the top of an air channel 73 in the cylinder top cap 7 is opened by the compressed air in the cylinder 5 thereby allowing the compressed air to be discharged through an air outlet. (FIGS. 5 and 6).

Figure 6:
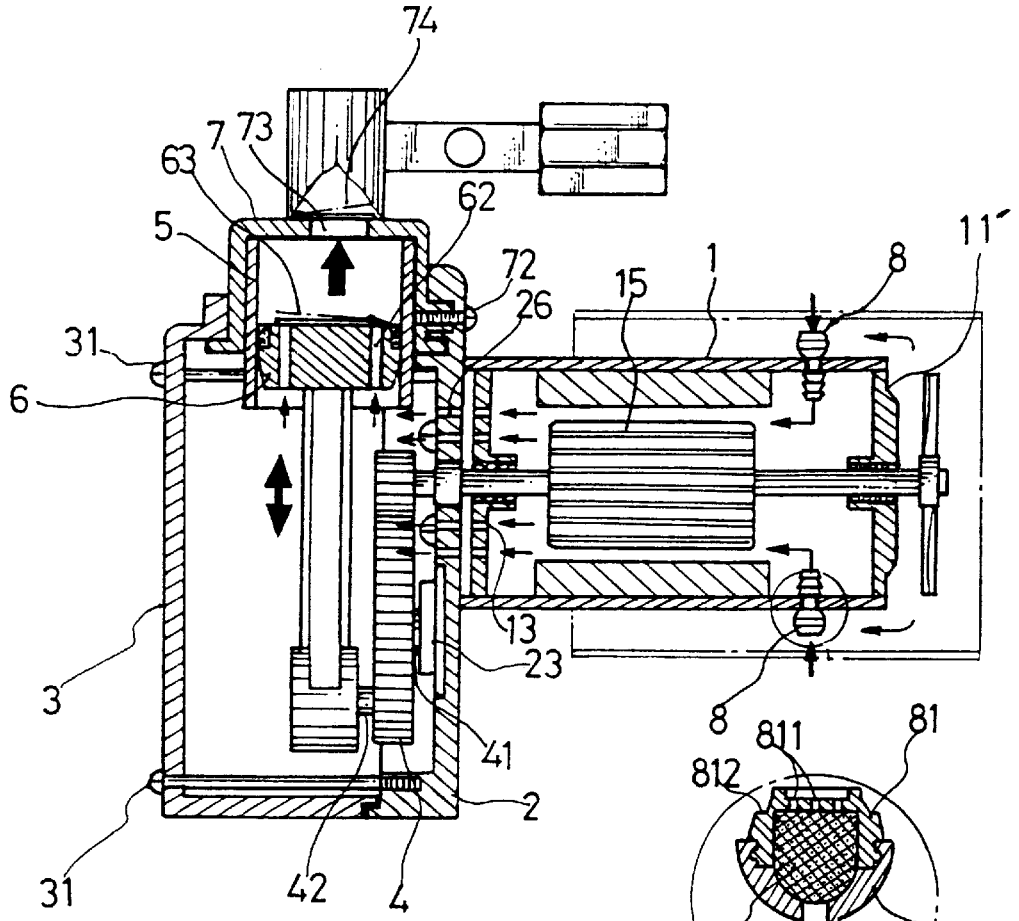
FIG. 6 is a sectional view of another preferred embodiment of the air pump in accordance with the present invention.
Figure 7:
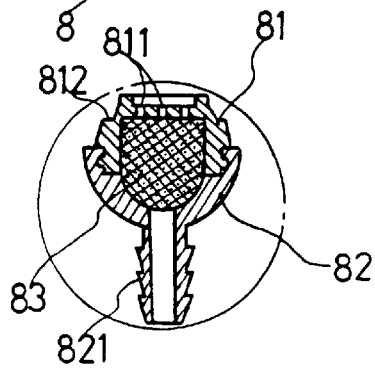
FIG. 7 is a sectional view of an air-filtering device of the present invention.
Figure 8:
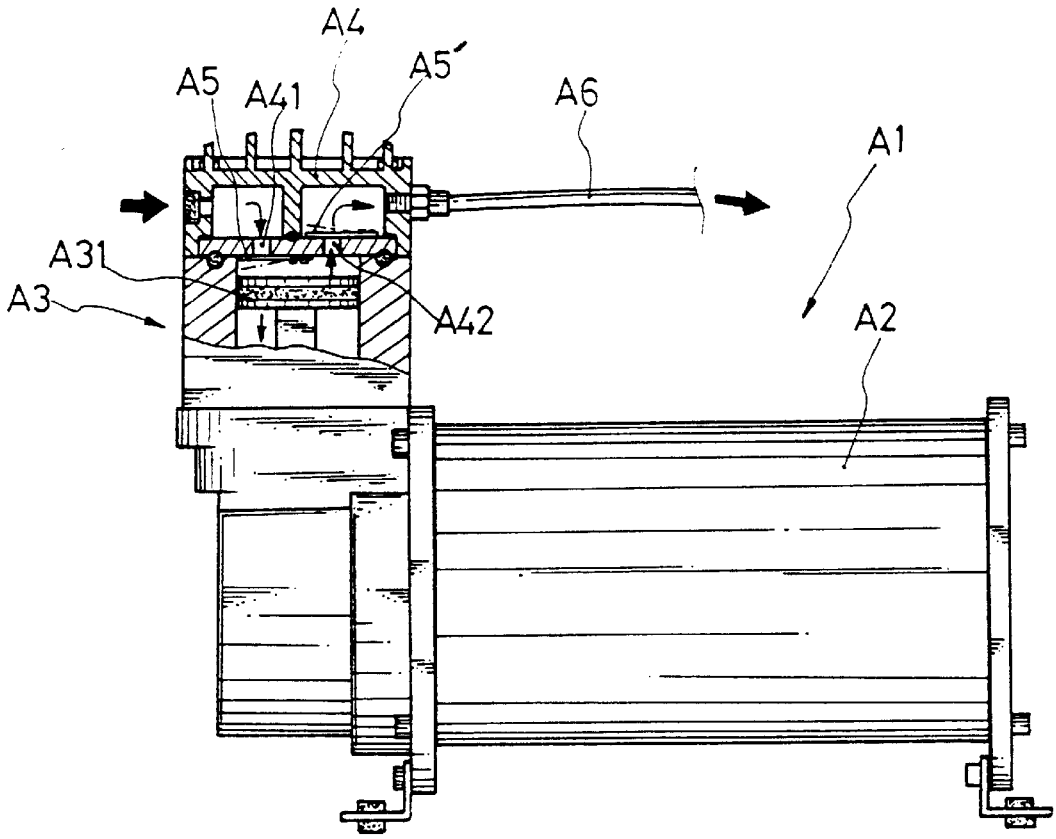
PRIOR ART FIG.8
FIG. 8 is a sectional view of a conventional air pump.

Referring to FIGS. 6 and 7, a filtering device 8 is positioned at the air slot 16 of motor body 1. The air-filtering device includes a top cap 81 mounted with a cap body 82. The top cap 81 is provided with air hole 811 and the extended circumferential edge is provided with water-stopping edge 812 to prevent water from dripping into the air hole 811. The cap body 82 is provided with an insertion section 821 and the interior thereof is provided with filtering aids 83 for air purification and filtering.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

What is claimed is:

1. An air pump, comprising:

a motor body having a main shaft, said motor body having a front sealing cap that is provided with a plurality of air inlets;

a cylinder seat having a plurality of air holes and connected to said motor body such that said plurality of air holes are positioned in corresponding relation to the plurality of air inlets such that air is allowed to flow from the motor body into the cylinder seat, said cylinder seat having a main shaft hole to accommodate the main shaft;

a driving gear connected to said main shaft;

an eccentric gear operatively engaging the driving gear, one side of said eccentric gear having a center shaft and an opposite side of said eccentric gear having an eccentric linking shaft, the center shaft being accommodated in a sealed hole in the cylinder seat;

a piston having a piston shaft provided with a shaft seal connected to the eccentric linking shaft to allow for reciprocating movement of the piston;

a silencer cap having a top section which forms a circular engaging mount with a top section of said cylinder seat;

a cylinder positioned within the circular mount so as to accommodate the piston; and a cap positioned over the cylinder.

2. An air pump according to claim 1, wherein an air slot is provided on said motor body.

3. An air pump according to claim 2, wherein a filtering device is mounted to said air slot.

4. An air pump according to claim 3, wherein the filtering device includes a top cover and a cap body, and a surface of the top cover is provided with a circumferential edge to prevent water from dripping into air holes therein, and the cap body is formed so as to accommodate air filtering aids.

5. An air pump according to claim 1, wherein a bolt is used to secure the silencer cap to the cylinder seat so as to properly position and secure the driving gear and eccentric gear.

6. An air pump according to claim 1, wherein an edge section of the cap, the cylinder and the top sections of the silencer cap and cylinder seat are simultaneously locked by a locking screw.

7. An air pump according to claim 6, wherein a second locking screw locks the motor body to the cylinder seat.

8. An air pump according to claim 1, further comprising:

a fan connected to the main shaft of the motor body at an opposite end of the main shaft than the driving gear;

an air slot is formed in the motor body to allow air blown from the fan to enter the interior of the motor body.

9. An air pump according to claim 8, further comprising:

a cylindrical casing at least partially surrounding the motor body and the fan.

10. An air pump according to claim 1, wherein said piston has an air inlet which forms a fluid passage through the piston to the cylinder.

11. An air pump according to claim 10, further comprising:

a valve positioned on the piston which opens and closes the air inlet according to the reciprocating movement of the piston.

12. An air pump according to claim 11, further comprising:

a second valve positioned over a fluid opening in said cap, said second valve opening and closing according to the reciprocating movement of the piston.

13. An air pump according to claim 1, wherein:

the plurality of air holes are positioned at a circumferential edge of the main shaft hole of the cylinder seat.

* * * * *